US006552636B1

(12) United States Patent
Yuanzhu

(10) Patent No.: US 6,552,636 B1
(45) Date of Patent: Apr. 22, 2003

(54) SMALL-SIZED CYLINDRICAL WAVEGUIDE BEND HAVING LOW REFLECTION CHARACTERISTIC

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/620,157

(22) Filed: Jul. 20, 2000

(30) Foreign Application Priority Data

Jul. 23, 1999 (JP) ..... 11-209210

(51) Int. Cl.[7] ..... H01P 1/02
(52) U.S. Cl. ..... 333/249; 333/21 A
(58) Field of Search ..... 333/249, 259, 333/21 A

(56) References Cited

U.S. PATENT DOCUMENTS 2,673,962 A * 3/1954 Kock ..... 333/249
3,072,870 A * 1/1963 Walker ..... 333/249
3,189,850 A * 6/1965 Walker ..... 333/249
3,219,955 A 11/1965 Inoue et al. ..... 333/249
3,452,306 A * 6/1969 Walker ..... 333/249

FOREIGN PATENT DOCUMENTS

FR 1 190 284 A 1/1959
GB 679902 * 9/1952 ..... 333/249
JP Hei 6 216633 8/1994

OTHER PUBLICATIONS

Weisshaar et al., "Accurate and Efficient CAD–Oriented Modeling of Circular Waveguide Bends", Microwave Symposium Digest, IEEE MTT–S International Denver, Colorado, USA 8–13, Jun. 8, 1997, pp. 1591–1594.

* cited by examiner

*Primary Examiner*—Benny Lee
(74) *Attorney, Agent, or Firm*—Brinks Hofer Gilson & Lione

(57) ABSTRACT

A small-sized cylindrical waveguide having a low reflection characteristic is disclosed. An inner bent portion connects cavities of first and second waveguide portions in a range of not larger than one-fourth of the diameter of the cavities on each of an extension line of an innermost wall portion in the cavity of the first waveguide portion and an extension line of an innermost wall portion in the cavity of the second waveguide portion, from an intersecting point of both extension lines.

5 Claims, 7 Drawing Sheets

SMALL-SIZED CYLINDRICAL WAVEGUIDE BEND HAVING LOW REFLECTION CHARACTERISTIC

BACKGROUND OF THE INVENTION

1. Field of the Invention

The present invention relates to a cylindrical waveguide to be used, for example, as a satellite broadcast transmitting and receiving antenna for the transmission and reception of a polarized wave.

2. Description of the Related Art

A satellite broadcast receiving converter using a conventional cylindrical waveguide will be described below with reference to FIGS. 8 and 9, of which FIG. 8 is an exploded perspective view of the conventional converter and FIG. 9 is an explanatory diagram for explaining a bent portion of a cavity in the cylindrical waveguide of the conventional converter.

As shown in FIGS. 8 and 9, a body member 31 formed by aluminum or zinc die casting comprises a cylindrical waveguide 32 for introducing a polarized wave and a housing 41 for receiving a circuit portion therein, the cylindrical waveguide 32 and the housing 41 being formed integrally with each other.

The cylindrical waveguide 32 has a first cylindrical waveguide portion 34 having a horn portion 33 for introducing a polarized wave, a second cylindrical waveguide portion 35 disposed perpendicularly to the first waveguide portion 34, and a cylindrical connection 36 which connects the first and second waveguide portions 34, 35 with each other and which is bent 90°. As depicted in FIG. 9, centrally and axially of the first waveguide portion 34 is formed a first cavity 37 which is straight, and also formed centrally and axially of the second waveguide portion 35 is a second cavity 38 which is straight. The first and second cavities 37, 38 are connected with each other through a 90°-bent cavity 39 which is formed in the connection 36 to form a cavity 40. Inside the horn portion 33 is formed a first opening 40*a* which opens one end of the cavity 40 as shown in FIG. 8. The opposite end side of the cavity 40 is also open.

Returning to FIG. 8, the housing 41, which is formed of the same material as the cylindrical waveguide 32, has a bottom wall portion 41*a*, a side wall portion 41*b* which is formed upright so as to enclose the bottom wall portion 41*a*, and a receptacle portion 41*c* which is open above the side wall portion 41*b* and which is enclosed with the side wall portion 41*b*. Near one end side of the bottom wall portion 41*a* is formed a second opening 41*d* which is an opposite end-side opening of the cavity 40.

On both upper and lower sides of a single rectangular circuit board 42 constituted by an insulating board are formed annular earth electrodes 43 as soldered layers each having about the same diameter as the second opening portion 41*d*. A large number of through holes 43*a* extending vertically through the circuit board 42 are formed in both upper- and lower-side earth electrodes 43 to connect the earth electrodes with each other.

A first probe 44 for catching a vertically polarized wave is formed by a conductive pattern longitudinally of the circuit board 42 from near the center of the earth electrode 43 formed on the upper side of the circuit board. On the other hand, in the transverse direction of the circuit board 42 is formed an L-shaped, second probe 45 by a conductive pattern to catch a horizontally polarized wave. One ends of the first and second probes 44, 45 are connected to an electric circuit (not shown) formed on the upper surface of the circuit board 42. The circuit board 42 is placed on a stepped portion located near the bottom wall portion 41*a* out of plural stepped portions (not shown) formed inside the housing 41 and is fixed to the housing by a suitable means. At this time, the earth electrode 43 formed on the lower side of the circuit board is grounded to the bottom wall portion 41*a* while surrounding the second opening 41*d* formed in the housing 41.

A generally square, bottomed, metallic case 46 is attached to the circuit board 42 so as to cover the earth electrode 43 formed on the upper side of the circuit board 42, by a suitable means such as the use of screws. An inside bottom (not shown) of the metallic case 46 functions as a short-circuit surface for the first and second probes 44, 45.

A cover 47 constituted by a single rectangular metallic plate is placed on a stepped portion (not shown) located on a remote side from the bottom wall portion 41*a* of the housing 41 and is fixed by a suitable means. The receptacle portion 41*c* of the housing 41 is sealed hermetically and the interior thereof is held in an electrically shielded state.

A more detailed description will now be given about the cavity 40 of the cylindrical waveguide 32. As shown in FIG. 9, the first and second cavities 37, 38 are each formed at a diameter of D1, and on the innermost side of the cavity 40 when seen sideways of the body member 31, the cavities 37 and 38 are constituted by an innermost wall portion 37*a* of the fist cavity 37, an innermost wall portion 38*a* of the second cavity 38, and an inner bent portion 39*a* as an innermost wall portion of the cavity 39 in the connection 36 which connects the first and second cavities 37, 38 with each other. On the outermost side of the cavity 40, the first and second cavities 37, 38 are constituted by an outermost inner wall portion 37*b* of the first cavity 37, an outermost inner wall portion 38*b* of the second cavity 38, and an outer bent portion 39*b* as an outermost inner wall portion of the cavity 39 in the connection 36.

The inner bent portion 39*a* has a quadrant circumference described with a radius of R2 which is three times as long as the diameter D1 from a central position C4, the central position C4 lying on a 45° line Z1—Z1 at an intersecting point of an extension line X1 of the innermost wall portion 37*a* of the first cavity 37 and an extension line Y1 of the innermost wall portion 38*a* of the second cavity 38. The innermost wall portions 37*a* and 38*a* of the first and second cavities 37, 38 are connected together at the radius R2. The outer bent portion 39*b* has a quadrant circumference described at a radius of R3 which is four times as long as the diameter D1 also from the central position C4. The outermost inner wall portions 37*b* and 38*b* are connected with each other at the radius R3.

In the satellite broadcast receiving converter using the conventional cylindrical waveguide, however, the central position of the radius R2 of the inner bent portion 39*a* of the cavity portion 39 in the connection 36 and the radius R3 of the outer bent portion 39*b* of the cavity 39 are the same and the radii R2 and R3 are respectively three and four times as long as the diameter D1, so that the cavity 39 is large in the directions of the extension lines X1 and Y1, with consequent increase in size of the connection 36, thus giving rise to the problem that the cylindrical waveguide 32 becomes larger in size.

SUMMARY OF THE INVENTION

It is an object of the present invention to provide a cylindrical waveguide which has a low reflection characteristic and which is small in size.

For achieving the above-mentioned object, according to the present invention, in the first aspect thereof, there is provided a cylindrical waveguide comprising a first waveguide portion having a cylindrical cavity, a second waveguide portion disposed perpendicularly to the first waveguide portion and having a cylindrical cavity, and a connection connecting the first and second waveguide portions with each other and having a bent cylindrical cavity, wherein an inner bent portion of an inner wall portion in the cavity of the connection connects the cavities of the first and second waveguide portions with each other on a bent right-angle side and at a first radius from a first central position, while an outer bent portion of the inner wall portion in the cavity of the connection connects the cavities of the first and second waveguide portions with each other on the bent right-angle side and at a second radius from a second central position, and the inner bent portion connects the cavities of the first and second waveguide portions with each other in a range of not larger than one-fourth of the diameter of the cavities on each of an extension line of the innermost wall portion in the cavity of the first waveguide portion and an extension line of the innermost wall portion in the cavity of the second waveguide portion, from an intersecting point of both extension lines.

In the second aspect of the present invention, the radius from the first central position is set zero, and the cavities of the first and second waveguide portions are connected perpendicularly to each other by the inner bent portion of the inner wall portion in the cavity of the connection.

In the third aspect of the present invention, the radius from the second central position is set 1.5 to 5 times as large as the cavity diameter, and the cavities of the first and second waveguide poritons are connected with each other by the outer bent portion of the inner wall portion in the cavity of the connection.

In the fourth aspect of the present invention, the first and second central positions lie on a 45° line which bisects the right-angled bent side.

DETAILED DESCRIPTION OF PREFERRED EMBODIMENTS

Figure 1:
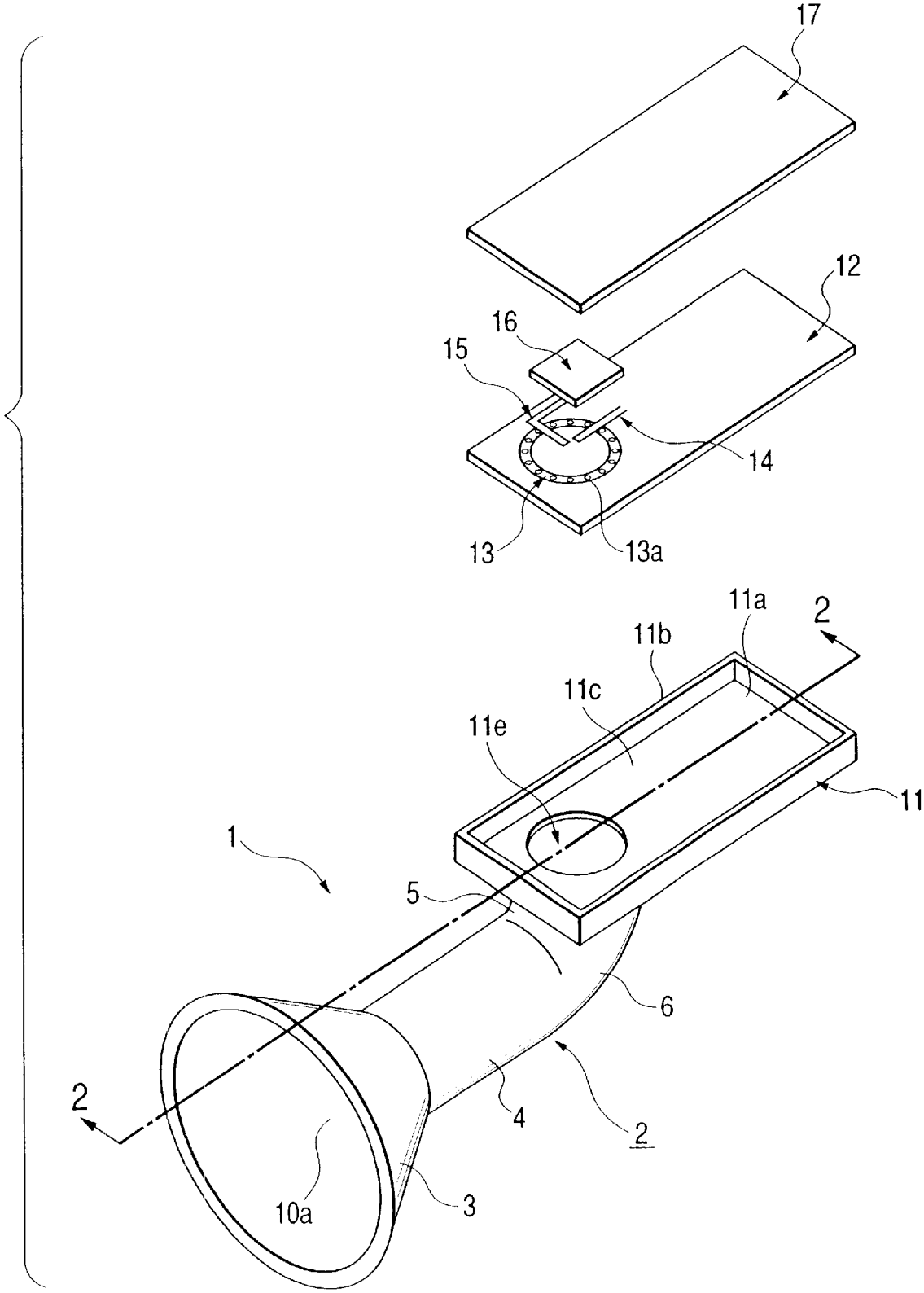
FIG. 1 is an exploded perspective view of a satellite broadcast receiving converter using a cylindrical waveguide according to the present invention.
Figure 2:
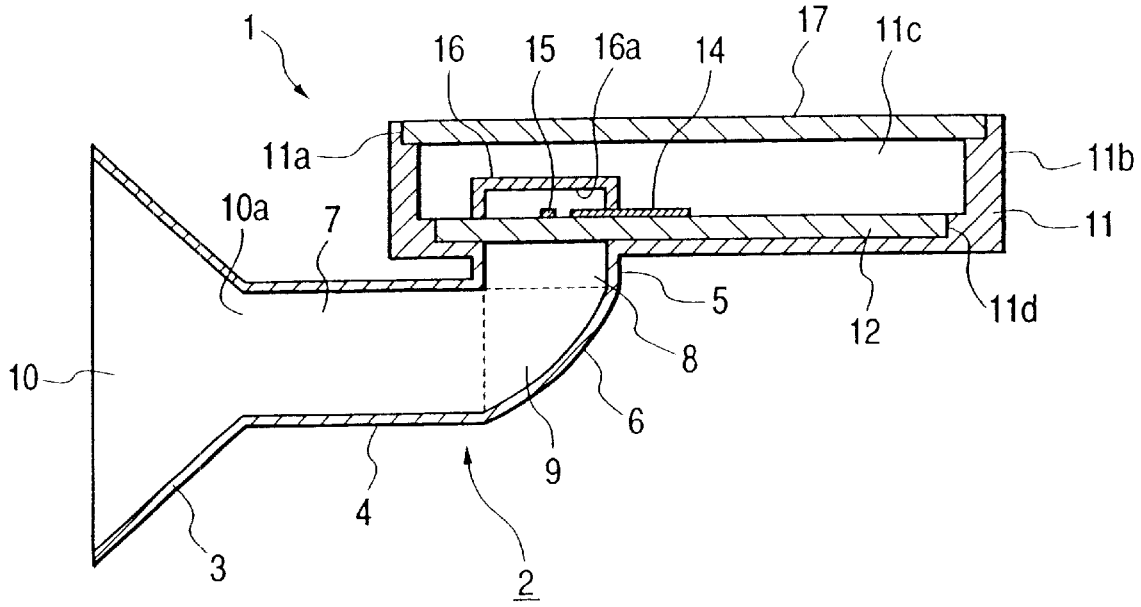
FIG. 2 is a sectional view taken on line 2—2 in FIG. 1 in an assembled state of the satellite broadcast receiving converter shown in FIG. 1.
Figure 3:
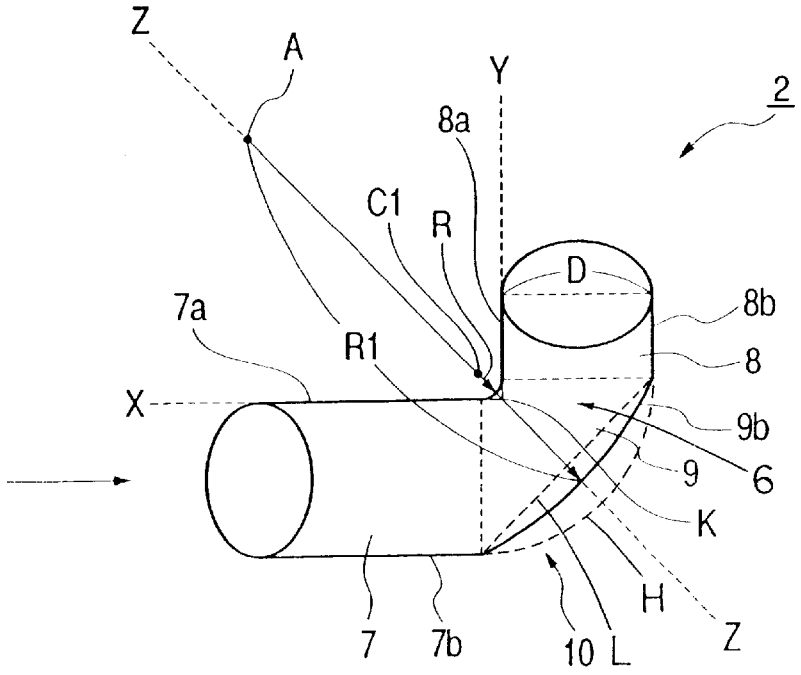
FIG. 3 is an explanatory diagram explaining a bent portion of a cavity in a cylindrical waveguide according to the first embodiment of the present invention.
Figure 4:
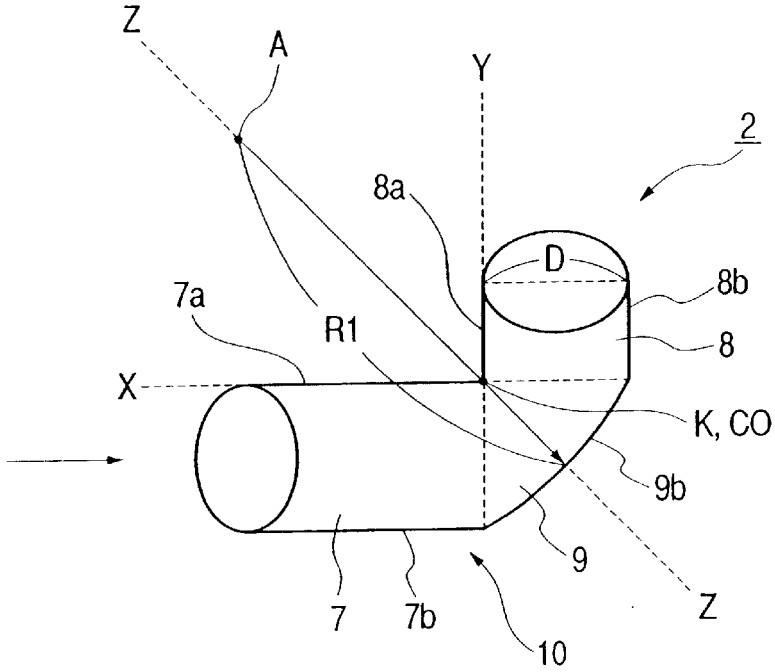
FIG. 4 is an explanatory diagram explaining a bent portion of a cavity in a cylindrical waveguide according to the second embodiment of the present invention.
Figure 5:
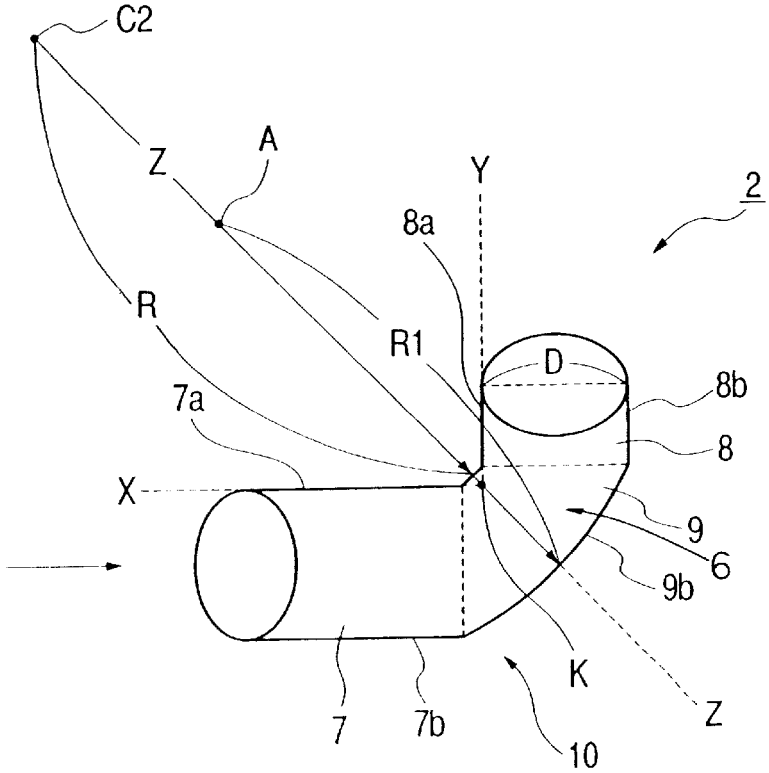
FIG. 5 is an explanatory diagram explaining a bent portion of a cavity in a cylindrical waveguide according to the third embodiment of the present invention.
Figure 6:
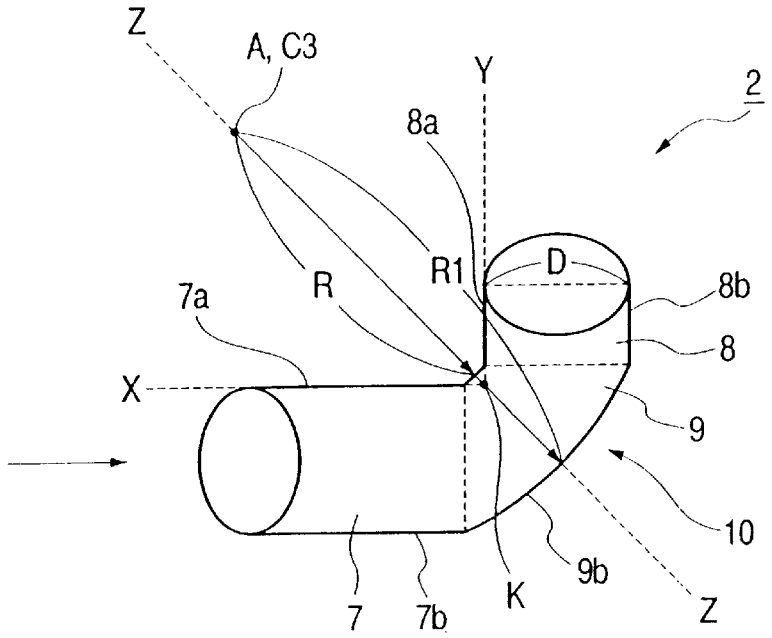
FIG. 6 is an explanatory diagram explaining a bent portion of a cavity in a cylindrical waveguide according to the present invention.
Figure 7:
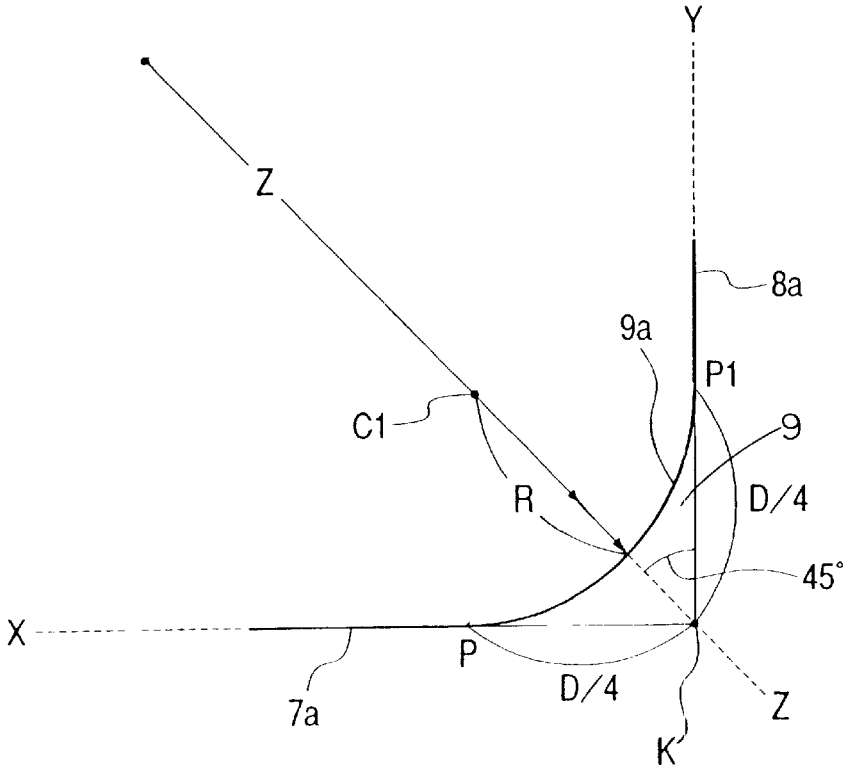
FIG. 7 is an enlarged explanatory diagram explaining an inner bent portion of an inner wall portion in a cavity of a connection formed in a cylindrical waveguide according to the present invention.
Figure 8:
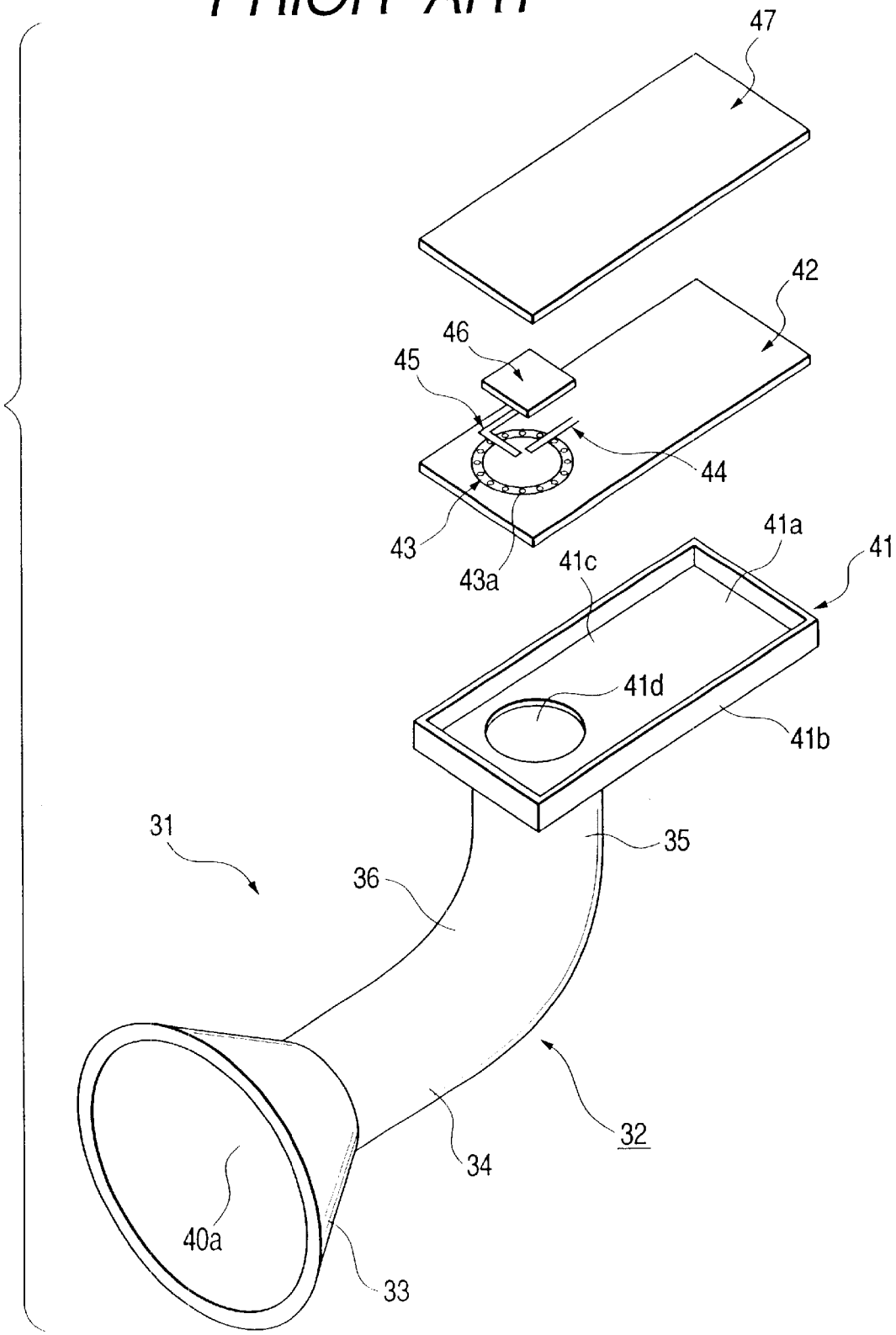
FIG. 8 PRIOR ART
FIG. 8 is an exploded perspective view of a satellite broadcast receiving converter using a conventional cylindrical waveguide.
Figure 9:
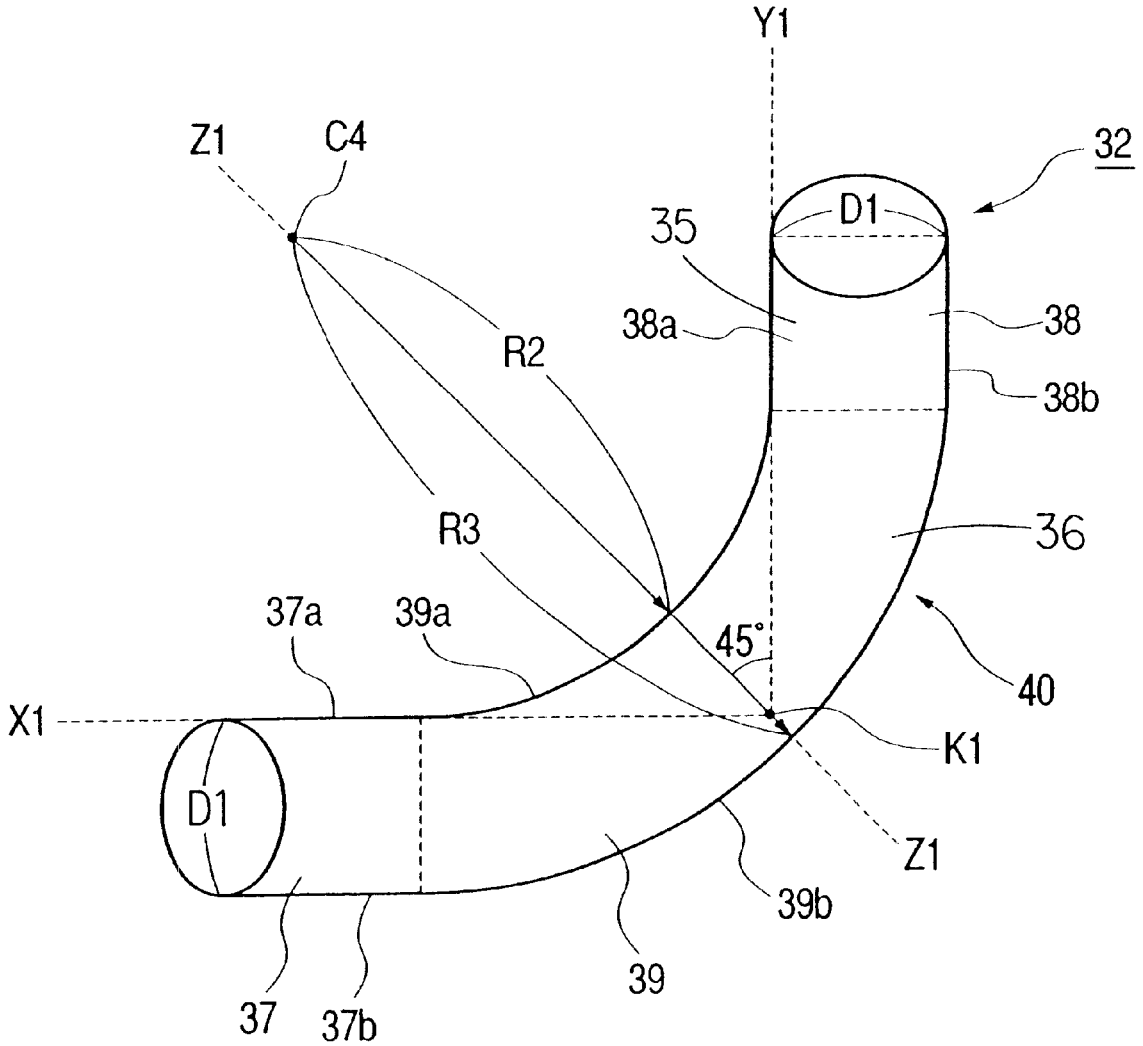
FIG. 9 PRIOR ART
FIG. 9 is an explanatory diagram explaining a bent portion of a cavity in the conventional cylindrical waveguide.
Figure 10:
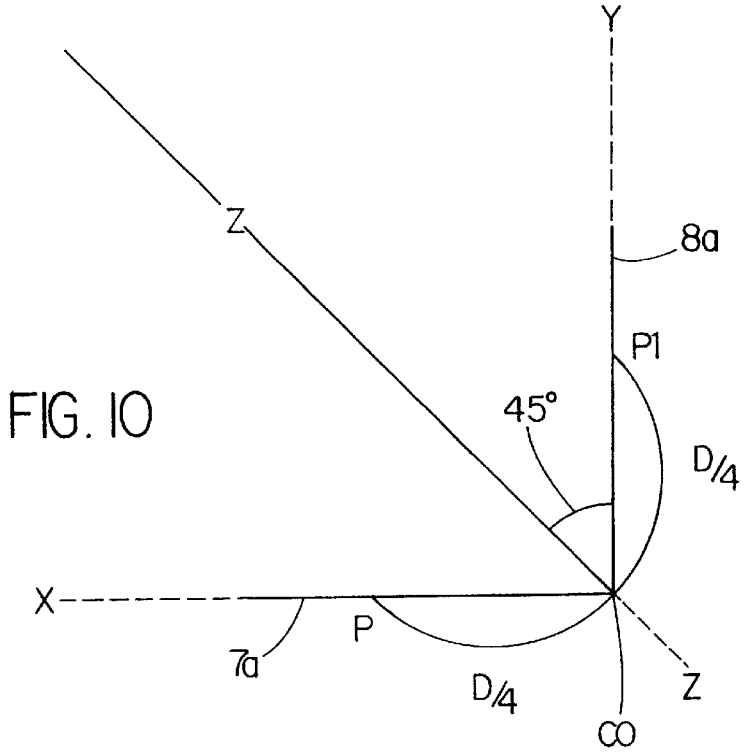
FIG. 10 is an explanatory diagram explaining a bent portion of a cavity in a cylindrical waveguide according to the second embodiment of the present invention.
Figure 11:
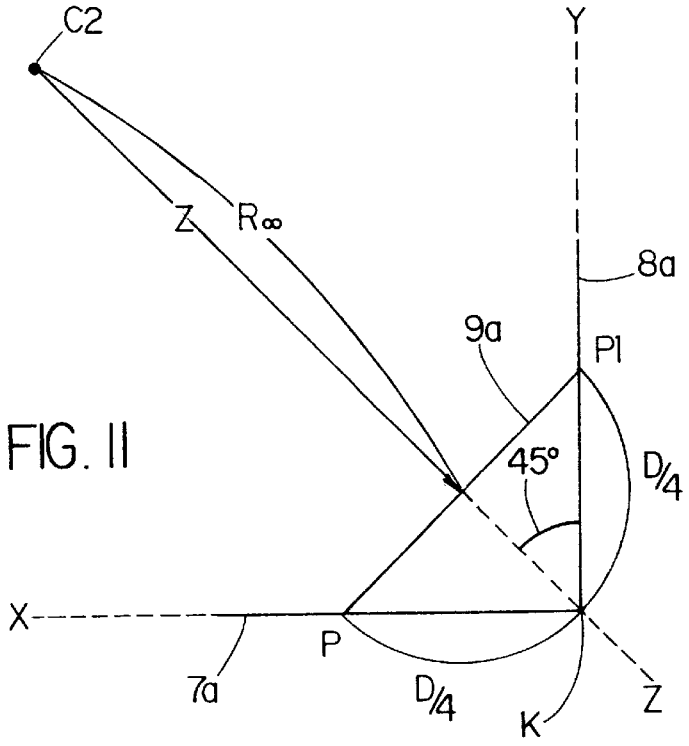
FIG. 11 is a an explanatory diagram explaining a bent portion of a cavity in a cylindrical waveguide according to the third embodiment of the present invention.

Cylindrical waveguides embodying the present invention will be described below in connection with a satellite broadcast receiving converter as an example and with reference to FIGS. 1 to 7, of which FIG. 1 is an exploded perspective view of a satellite broadcast receiving converter using a cylindrical waveguide according to the present invention, FIG. 2 is a sectional view taken on line 2—2 in FIG. 1 in an assembled state of the satellite broadcast receiving converter shown in FIG. 1, FIG. 3 is an explanatory diagram explaining a bent portion of a cavity in a cylindrical waveguide according to the first embodiment of the present invention, FIG. 4 is an explanatory diagram explaining a bent portion of a cavity in a cylindrical waveguide according to the second embodiment of the present invention, FIG. 5 is an explanatory diagram explaining a bent portion of a cavity in a cylindrical waveguide according to the third embodiment of the present invention, FIG. 6 is an explanatory diagram explaining a bent portion of a cavity in a cylindrical waveguide according to the present invention, and FIG. 7 is an enlarged explanatory diagram explaining an inner bent portion of an inner wall portion in a cavity of a connection formed in a cylindrical waveguide according to the present invention.

In FIGS. 1 and 2, a body member 1, which is formed by aluminum or zinc die casting, comprises a cylindrical waveguide 2 for introducing a polarized wave and a housing 11 for receiving a circuit portion therein.

The cylindrical waveguide 2 comprises a first cylindrical waveguide portion 4 having a horn portion 3 for introducing a polarized wave, a second cylindrical waveguide portion 5 disposed perpendicularly to the first waveguide portion 4, and a 90°-bent cylindrical connection 6 which connects the first and second waveguide portions 3, 5 with each other. As seen in FIG. 2, centrally and axially of the first waveguide portion 4 is formed a first cavity 7 which is straight. Likewise, a second cavity 8, which is also straight, is formed centrally and axially of the second waveguide portion 5. The first and second cavities 7, 8 are connected to a 90°-bent cavity 9 formed in the connection 6 to form a cavity 10 (see FIG. 2). Inside the horn 3 is formed a first opening 10*a* as an opening at one end of the cavity 10. The opposite end side of the cavity 10 is also open.

The housing 11, which is formed of the same material as the material of the cylindrical waveguide 2, comprises a bottom wall portion 11*a* (see FIG. 1), a side wall portion 11*b* formed upright so as to enclose the bottom wall portion 11*a*, and a receptacle portion 11*c* which is enclosed with the side wall portion 11*b* so as to be open above the side wall portion. Inside the side wall portion 11*b* are formed a plurality of stepped portions 11*d* (see FIG. 2). Near one end side of the bottom wall portion 11*a* is formed a second opening 11*e* as an opening on the opposite end side of the cavity 10.

On both upper and lower sides of a single rectangular circuit board 12 constituted by an insulating board are formed annular earth electrodes 13 (see FIG. 1) of about the same diameter as the diameter of the second opening 11*e*, the earth electrodes 13 being each formed by a soldered layer. As shown in FIG. 1 a large number of through holes 13*a* are formed in the upper and lower earth electrodes 13 to as to extend vertically through the circuit board 12, thereby connecting the earth electrodes with each other.

A first probe 14 for catching a vertically polarized wave is formed by a conductive pattern longitudinally of the circuit board 12 from near the center of the earth electrode formed on the upper side of the circuit board. On the other hand, in the transverse direction of the circuit board 12 is formed an L-shaped, second probe 15 by a conductive pattern for catching a horizontally polarized wave. One ends of the first and second probes 14, 15 are connected to an electric circuit (not shown) formed on the upper side of the circuit board 12. The circuit board 12 is placed on a stepped portion located near the bottom wall portion 11*a* of the housing 11 out of plural stepped portions 11*d* formed inside the housing and is fixed to the housing by a suitable means. At this time, the earth electrode 13 formed on the lower side of the circuit board is grounded to the bottom wall portion 11*a* in a surrounding relation to the second opening 11*e*.

A generally square, bottomed, metallic case 16 is mounted to the circuit board 12 so as to cover the earth electrode 13 formed on the upper side of the circuit board, by a suitable means such as the use of screws. An inner bottom 16*a* (see FIG. 2) of the metallic case 16 functions as a short-circuit surface for the first and second probes 14, 15.

A cover 17, which is constituted by a single rectangular metallic plate, is placed on a stepped portion on a remote side from the bottom wall portion 11*a* out of the stepped portions 11*d* formed on the side wall portion 11*b* of the housing 11 and is fixed by a suitable means. The receptacle portion 11*c* of the housing 11 is hermetically sealed and the interior thereof is shielded electrically.

The cavity 10 of the cylindrical waveguide 2 (see FIG. 3) will now be described in more detail. In the cylindrical waveguide 2 according to the second embodiment of the present invention, as shown in FIGS. 3 and 7, the first and second cavities 7, 8 (see FIG. 3) are each formed at a diameter of D (see FIG. 3). When seen sideways of the body member 1 (see FIG. 1), on the innermost side of the cavity 10, the first and second cavities 7, 8 are formed by an innermost wall portion 7*a* of the first cavity 7, an innermost wall portion 8*a* of the second cavity 8, an inner bent portion 9*a* (see FIG. 3) as an innermost wall portion of the cavity 9 in the connection 6 which connects the innermost wall portions 7*a* and 8*a* with each other, while on the outermost side of the cavity 10 (see FIG. 3), the first and second cavities 7, 8 are formed by an outermost inner wall portion 7*b* (see FIG. 3) of the first cavity 7, an outermost inner wall portion 8*b* (see FIG. 3) of the second cavity 8, and an outer bent portion 9*b* (see FIG. 3) as an outermost inner wall portion of the cavity 9 in the connection 6 which connects the outermost inner wall portions 7*b* and 8*b* with each other. The outer bent portion 9*b* is positioned inside a dash line H, as seen in FIG. 3 that connects the end of the outermost inner wall portion 7*b* of the first cavity 7 and the end of the outermost inner wall portion 8*b* of the second cavity 8. Also, the outer bend portion 9*b* is positioned outside a straight line, indicated in FIG. 3, by a dash line L connecting the end of the outermost inner wall 7*b* of the first cavity 7 and the end of the outermost inner wall portion 8*b* of the second cavity 8. The inner bent portion 9*a* as the innermost wall portion in the cavity 9 of the connection 6 has a quadrant circumference of a first radius R at a first central position C1 on a 45° line Z at an intersecting point K of an extension line X of the inner wall portion 7*a* in the first cavity 7 and an extension line Y of the inner wall portion 8*a* in the second cavity 8 as shown in FIG. 7. At the radius R, the inner wall portions 7*a* and 8*a* of the first and second cavities 7, 8 are connected with each other as shown in FIG. 4. In this first embodiment, as shown in FIG. 7, the inner bent portion 9*a* in the cavity 9 connects the inner wall portion 7*a* of the first cavity 7 and the inner wall portion 8*a* of the second cavity 8 with each other at a first connection point p and a second connection point p1 lying at one-fourth positions of the diameter D (i.e. D/4) on the extension lines X and Y, respectively, from the intersecting point K of both extension lines.

The following description is now provided about a cylindrical waveguide 2 according to the second embodiment of the present invention. In this second embodiment, as shown in FIGS. 4 and 7, the first central position C1 in the above first embodiment is displaced to the outer bent portion 9*b* side of the cavity 9 on the line Z and the position of the intersecting point K is made a central position C0. As best seen in FIGS. 4, 5 and 6 cylindrical waveguide 2 is shown having a cavity 10 that is formed of cavities 7, 8 and 9. Cavities 7 and 8 have diameters D and the line Z is a 45° line that extends through intersection point K. That is, the first radius R of the inner bent portion 9*a* in the cavity 9 is made zero and the first central position C1 is set at the intersecting point K of the extension line X of the inner wall portion 7*a* in the first cavity 7 and the extension line Y of the inner wall portion 8*a* in the second cavity 8. As a result, the innermost wall portions 7*a* and 8*a* of the cavities 7 and 8 in the first and second waveguide portions 4, 5 are directly connected perpendicularly to each other.

A description will now be given of a cylindrical waveguide 2 according to the third embodiment of the present invention. As shown in FIGS. 5 and 7, the first central position C1 (FIG. 7) is displaced so as to increase the radius R∞, allowing the first radius R of the inner bent portion 9*a* in the cavity 9 to become infinite, and the first central position is set at C2. At this time, as shown in FIG. 7, the inner bent portion 9*a* of the cavity 9 is in the form of a line which substantially intersects the line Z perpendicularly, and connects the innermost wall portion 7*a* of the first cavity 7 and the innermost wall portion 8*a* of the second cavity with each other at the first and second connection points p,p1.

Thus, in the cylindrical waveguide 2 according to any of the above first to third embodiments, the inner bent portions of the innermost wall portion in the cavity 9 of the connection 6 connects the innermost wall portion 7*a* of the first cavity 7 and the innermost wall portion 8*a* of the second cavity 8 with each other. This connection has a radius that extends through intersection point K and the length of this radius is within the range of zero to one-fourth of the diameter D/4 on the extension lines X and Y from the intersection point K of the extension line X of the innermost wall portion 7*a* and the extension line Y of the innermost wall portion 8*a*.

Reference will now be made to the structure on the outermost side of the cavity 10 in the cylindrical waveguide 2. As shown in FIGS. 3 to 6, the outermost inner wall portion 9*b* in the cavity 9 of the connection 6 is in the form of a circumference of radius R1 from the second central position A which lies on the 45° line Z at the intersecting point K of the extension line X of the innermost wall portion 7*a* in the first cavity 7 and the extension line Y of the innermost wall portion 8*a* in the second cavity 8. The radius R1 is 1.5 to 5 times as large as the diameter D. The outer bent portion 9*b* in the cavity 9 connects the outermost inner wall portion 7*b* in the first cavity 7 and the outermost inner wall portion 8*b* in the second cavity 8 with each other.

It is optional whether the second central position A and the first central position C3 are to be coincident with each other as in FIG. 6 or different as in the above first to third embodiments.

It goes without saying that the present invention is not limited to the above embodiments. The first central position C1 may be established independently of the second central position A, and both central positions C1 and A need not lie on the 45° line Z. Further, the cylindrical waveguide 2 according to the present invention may be applied to not only a converter for reception but also a converter for transmission.

As set forth above, in the cylindrical waveguide according to the present invention, the cavities in the first and second waveguide portions are connected with each other within the range of not larger than one-fourth of the cavity diameter on each of an extension line of the innermost wall portion in the cavity of the first waveguide portion and an extension line of the innermost wall portion in the cavity of the second waveguide portion and from an intersecting point of both extension lines. Therefore, the connection can be formed small and it is possible to provide a small-sized cylindrical waveguide. Besides, since the second central position can be established independently of the first central position, the radius of the outer bent portion from the second central position can be set freely so as to afford a low reflection characteristic without affecting the reduction of size. In other words, it is possible to provide a small-sized cylindrical waveguide while attaining a low reflection characteristic.

Moreover, since the radius from the first central position is set zero and the cavities of the first and second waveguide portions are connected perpendicularly to each other by the inner bent portion of the inner wall portion in the cavity of the connection, not only the cavity in the connection of the cylindrical waveguide but also the connection itself becomes smaller in size, thus permitting the provision of a cylindrical waveguide smaller in size. Besides, since the cavities in the first and second waveguide portions are connected perpendicularly to each other, the structure of a mold to be used for molding the body member becomes simpler and a cylindrical waveguide superior in mass-productivity can be provided at a lower cost.

Further, since the radius from the second central position is set 1.5 to 5 times as large as the cavity diameter and the cavities in the first and second waveguide portions are connected together by the outer bent portion of the inner wall portion in the cavity of the connection, the curvature of the outer bent portion of the inner wall portion in the cavity of the connection can be set in a range capable of affording a good low reflection characteristic, thus making it possible to provide a highly reliable, cylindrical waveguide.

Since the first and second central positions lie on a 45° line which bisects a bent right angle, the mold structure becomes still simpler and it is possible to provide a cylindrical waveguide superior in mass-productivity at a lower cost.

What is claimed is:

1. A cylindrical waveguide comprising:

a first waveguide portion having a cylindrical cavity of a predetermined diameter;

a second waveguide portion disposed perpendicularly to the first waveguide portion and having a cylindrical cavity of said predetermined diameter; and a connection connecting the first and second waveguide portions with each other and having a bent cylindrical cavity, wherein an inner bent portion of an inner wall portion in the cavity of the connection connects the cavities of the first and second waveguide portions with each other on an inner bent right-angle side and at a first radius from a first central position, while an outer bent portion of the inner wall portion in the cavity of the connection connects the cavities of the first and second waveguide portions with each other on an outer bent right-angle side and at a second radius from a second central position, and the inner bent portion connects the cavities of the first and second waveguide portions with each other in a range from zero to no larger than one-fourth of the predetermined diameter of the respective cavities on each of an extension line of the innermost wall portion in the cavity of the first waveguide portion and an extension line of the innermost wall portion in the cavity of the first waveguide portion and an extension line of the innermost wall portion in the cavity of the second waveguide portion, from an intersecting point of the extension lines;

the second radius from the second central position is set 1.5 to 5 times as large as said predetermined diameter, and the cavities of the first and second waveguide portions are connected with each other by the outer bent portion of the inner wall portion in the cavity of the connection; and said first and second central positions lie on a 45° line which bisects the bent right-angle side.

2. A cylindrical waveguide comprising:

a first waveguide portion having a cylindrical cavity of a predetermined diameter;

a second waveguide portion disposed perpendicularly to the first waveguide portion and having a cylindrical cavity of said predetermined diameter;

a connection connecting the first and second waveguide portions with each other and having a bent cylindrical cavity, wherein an inner bent portion of an inner wall portion in the cavity of the connection connects the cavities of the first and second waveguide portions with each other on an inner bent right-angle side and at a first radius from a first central position, while an outer bent portion of the inner wall portion in the cavity of the connection connects the cavities of the first and second waveguide portions with each other on an outer bent right-angle side and at a second radius from a second central position, and the inner bent portion connects the cavities of the first and second waveguide portions with each other in a range from zero to no larger than one-fourth of the predetermined diameter of the respective cavities on each of an extension line of the innermost wall portion in the cavity of the first waveguide portion and an extension line of the innermost wall portion in the cavity of the first waveguide portion and an extension line of the innermost wall portion in the cavity of the second waveguide portion, from an intersecting point of the extension lines;

the second radius from the second central position is set 1.5 to 5 times as large as said predetermined diameter, and the cavities of the first and second waveguide portions are connected with each other by the outer bent portion of the inner wall portion in the cavity of the connection; and said first and second central positions lie on a 45° line which bisects the bent right-angle side and the radius from the first central position is zero such that the cavities of the first and second waveguide portions are connected perpendicularly to each other by the inner bent portion of the inner wall portion in the cavity of the connection.

3. A cylindrical waveguide comprising:

a first waveguide portion having a cylindrical cavity of a predetermined diameter;

a second waveguide portion disposed perpendicularly to the first waveguide portion and having a cylindrical cavity of said predetermined diameter; and a connection connecting the first and second waveguide portions with each other and having a bent cylindrical cavity, wherein an inner bent portion of an inner wall portion in the cavity of the connection connects the cavities of the first and second waveguide portions with each other on an inner bent right-angle side and at a first radius from a first central position, while an outer bent portion of the inner wall portion in the cavity of the connection connects the cavities of the first and second waveguide portions with each other on an outer bent right-angle side and at a second radius from a second central position, and the inner bent portion connects the cavities of the first and second waveguide portions with each other in a range from zero to no larger than one-fourth of the predetermined diameter of the respective cavities on each of an extension line of the innermost wall portion in the cavity of the first waveguide portion and an extension line of the innermost wall portion in the cavity of the first waveguide portion and an extension line of the innermost wall portion in the cavity of the second waveguide portion, from an intersecting point of the extension lines;

the second radius from the second central position is set 1.5 to 5 times as large as said predetermined diameter, and the cavities of the first and second waveguide portions are connected with each other by the outer bent portion of the inner wall portion in the cavity of the connection; and said first and second central positions lie on a 45° line which bisects the bent right-angle sides and the inner and outer bent portion is defined by a line that intersects and is perpendicular to said 45° line and connects the innermost wall portion of the first cavity and the innermost wall portion of the second cavity with each other from points on the extension lines of the innermost wall portions that are less than ¼ of the predetermined diameter from the intersection of the extension lines.

4. A cylindrical waveguide as set forth in claim 3 wherein:

the radius from the first central position is infinity.

5. A cylindrical waveguide comprising:

a first waveguide portion having a cylindrical cavity of a predetermined diameter;

a second waveguide portion disposed perpendicularly to the first waveguide portion and having a cylindrical cavity of said predetermined diameter;

a connection connecting the first and second waveguide portions with each other and having a bent cylindrical cavity, wherein an inner bent portion of an inner wall portion in the cavity of the connection connects the cavities of the first and second waveguide portions with each other on an inner bent right-angle side and at a first radius from a first central position, while an outer bent portion of the inner wall portion in the cavity of the connection connects the cavities of the first and second waveguide portions with each other on an outer bent right-angle side and at a second radius from a second central position, and the inner bent portion connects the cavities of the first and second waveguide portions with each other in a range from zero to no larger than one-fourth of the predetermined diameter of the respective cavities on each of an extension line of the innermost wall portion in the cavity of the first waveguide portion and an extension line of the innermost wall portion in the cavity of the first waveguide portion and an extension line of the innermost wall portion in the cavity of the second waveguide portion, from an intersecting point of the extension lines;

the second radius from the second central position is set 1.5 to 5 times as large as said predetermined diameter, and the cavities of the first and second waveguide portions are connected with each other by the outer bent portion of the inner wall portion in the cavity of the connection; and said first and second central positions lie at the same position at the same position on a 45° line which bisects the bent right-angle side.

* * * * *

UNITED STATES PATENT AND TRADEMARK OFFICE

CERTIFICATE OF CORRECTION

PATENT NO. : 6,552,636 B1
DATED : April 22, 2003
INVENTOR(S) : Dou Yuanzhu

It is certified that error appears in the above-identified patent and that said Letters Patent is hereby corrected as shown below:

Title page,
Item [56], OTHER PUBLICATIONS, after "Digest," insert -- 1997, --.

Signed and Sealed this

Twenty-eighth Day of October, 2003

JAMES E. ROGAN
*Director of the United States Patent and Trademark Office*